US009573239B2

(12) United States Patent
Burgard

(10) Patent No.: US 9,573,239 B2
(45) Date of Patent: Feb. 21, 2017

(54) APPARATUS AND METHOD EMPLOYING A GRINDER WHEEL COOLANT GUARD

(75) Inventor: Daniel Burgard, Wauseon, OH (US)

(73) Assignee: FIRST SOLAR, INC., Perrysburg, OH (US)

( * ) Notice: Subject to any disclaimer, the term of this patent is extended or adjusted under 35 U.S.C. 154(b) by 806 days.

(21) Appl. No.: 13/597,971

(22) Filed: Aug. 29, 2012

(65) Prior Publication Data

US 2013/0052921 A1 Feb. 28, 2013

Related U.S. Application Data

(60) Provisional application No. 61/528,490, filed on Aug. 29, 2011.

(51) Int. Cl.
*B24B 13/00* (2006.01)
*B24B 9/10* (2006.01)
*B24B 55/02* (2006.01)

(52) U.S. Cl.
CPC ..... *B24B 9/102* (2013.01); *B24B 55/02* (2013.01)

(58) Field of Classification Search
CPC ..... B24B 55/02; B24B 9/102; B24B 7/12; B24B 7/242; B24B 7/244; B23Q 11/08; B23Q 11/0875
See application file for complete search history.

(56) References Cited

U.S. PATENT DOCUMENTS 2,671,992 A * 3/1954 Reaser ..... B24B 9/102 451/190
2,913,853 A * 11/1959 Solem ..... 451/70
3,066,452 A * 12/1962 Bott ..... A61L 17/08 451/209
3,113,220 A 12/1963 Goulding et al.
3,148,488 A * 9/1964 Reaser ..... B24B 55/045 451/450
4,060,937 A * 12/1977 Glazer ..... B24B 9/102 271/267
4,199,377 A 4/1980 Corwin et al.
4,867,133 A 9/1989 Sadler et al.
5,022,930 A 6/1991 Ackerman et al.
5,342,156 A * 8/1994 Baba ..... B23Q 11/0891 408/710
6,176,656 B1 * 1/2001 Seong ..... B23Q 1/66 29/DIG. 56
6,264,538 B1 * 7/2001 Rettig ..... B23Q 7/003 451/120
6,288,326 B1 9/2001 Hayashi et al.
7,125,320 B1 * 10/2006 Brown ..... B24B 55/04 451/365

(Continued)

FOREIGN PATENT DOCUMENTS

JP 2003266306 A * 9/2003
JP WO 03076132 A1 * 9/2003 ..... B24B 9/10

(Continued)

*Primary Examiner* — Joseph J Hail
*Assistant Examiner* — Joel Crandall
(74) *Attorney, Agent, or Firm* — Blank Rome LLP

(57) ABSTRACT

Edges of panels, such as glass panels, are ground and polished using grinder wheels that are cooled and lubricated with a coolant. A coolant deflector is utilized to help prevent coolant, which may contain panel particles or abrasives, from entering between the panel and a conveying mechanism that transports the panel.

25 Claims, 22 Drawing Sheets

(56) References Cited

U.S. PATENT DOCUMENTS

| | | | | |
|---|---|---|---|---|
| 7,908,743 | B2 | 3/2011 | Li et al. | |
| 2005/0090189 | A1* | 4/2005 | Brown | B24B 55/04 451/41 |
| 2009/0139567 | A1 | 6/2009 | Liu et al. | |
| 2009/0287446 | A1 | 11/2009 | Wang et al. | |
| 2010/0112910 | A1* | 5/2010 | Brown | B24B 9/10 451/44 |

FOREIGN PATENT DOCUMENTS

| | | | | | |
|---|---|---|---|---|---|
| JP | | 2006346803 | A * | 12/2006 | |
| JP | WO | 2012073626 | A1 * | 6/2012 | B24B 55/02 |
| WO | WO | 2008041449 | A1 * | 4/2008 | |
| WO | WO | 2009081637 | A1 * | 7/2009 | |

* cited by examiner

APPARATUS AND METHOD EMPLOYING A GRINDER WHEEL COOLANT GUARD

CROSS-SECTION TO RELATED APPLICATION

The present application claims priority to Provisional Application No. 61/528,490, filed Aug. 29, 2011, the entirety of which is incorporated by reference.

TECHNICAL FIELD

The disclosed embodiments relate to a grinder coolant guard and coolant deflector for use in the manufacture of glass panels used in the construction of photovoltaic modules.

BACKGROUND

Glass panels are utilized in the manufacture of photovoltaic (PV) modules and are typically used as front and back covers of a module. One purpose of a glass panel used as a front cover of a PV module is to permit the transmission of sunlight to PV cells within the PV module. As is well known in the art, the PV cells convert the sunlight into electricity. Consequently, a PV module is more efficient if sunlight is transmitted to the PV cells with minimal obstructions.

Another purpose of the front cover, as well as the back cover, of a PV module is to protect the PV cells within the module from external environmental conditions. Exposure of the PV cells to external environmental conditions may shorten the productive life of the PV module. A further purpose of either the front or back cover is to be a foundation upon which the PV module is built.

Thus, it is desirable to prevent any defect from occurring in the glass panels as defects may cause the panels to fail to meet PV manufacturing specifications, in which case the panels may have to be discarded. These defects may impair the transmission of light to the PV cells, which may cause the PV module to operate inefficiently, and eventually expose the PV cells to external environmental conditions, which may hasten the end of the productive life of the PV module. Generally, before using the glass panels in the assembly of a PV module, grinder wheels are used to machine the panels down to their finished size and/or smooth or polish their edges to reduce edge defects. A coolant, for example water, is used to lubricate and cool the grinder wheels. The coolant constantly flows over the grinder wheels and incidentally flows onto the glass panels. Glass particles produced in the grinding process or abrasive particles from the grinder wheels may be collected in the coolant. If coolant containing glass or abrasive particles becomes trapped between a transporting conveyor mechanism and a glass panel, the particles can cause undesirable scratches or inclusions in the glass panel's surface. Thus, these undesirable particles need to be removed from the coolant lest they scratch the surface of the glass panels. However, removal of such particles requires additional manufacturing steps.

Accordingly, it is desirable to prevent coolant, which may contain glass or other abrasive particles, from overflowing onto a glass panel where the particles may become trapped between a conveyor mechanism and the glass panels or where the particles may come into contact with the surface of the glass panel upon which further processing will occur.

DETAILED DESCRIPTION

In the following detailed description, reference is made to the accompanying drawings, which form a part hereof, and in which specific embodiments are illustrated that may be practiced. These embodiments are described in sufficient detail to enable those skilled in the art to make and use them. It is to be understood that structural, logical, or procedural changes may be made to the specific embodiments disclosed without departing from the spirit and scope of the invention. Other features, objects, and advantages will be apparent from the description, drawings, and claims.

Figure 1:
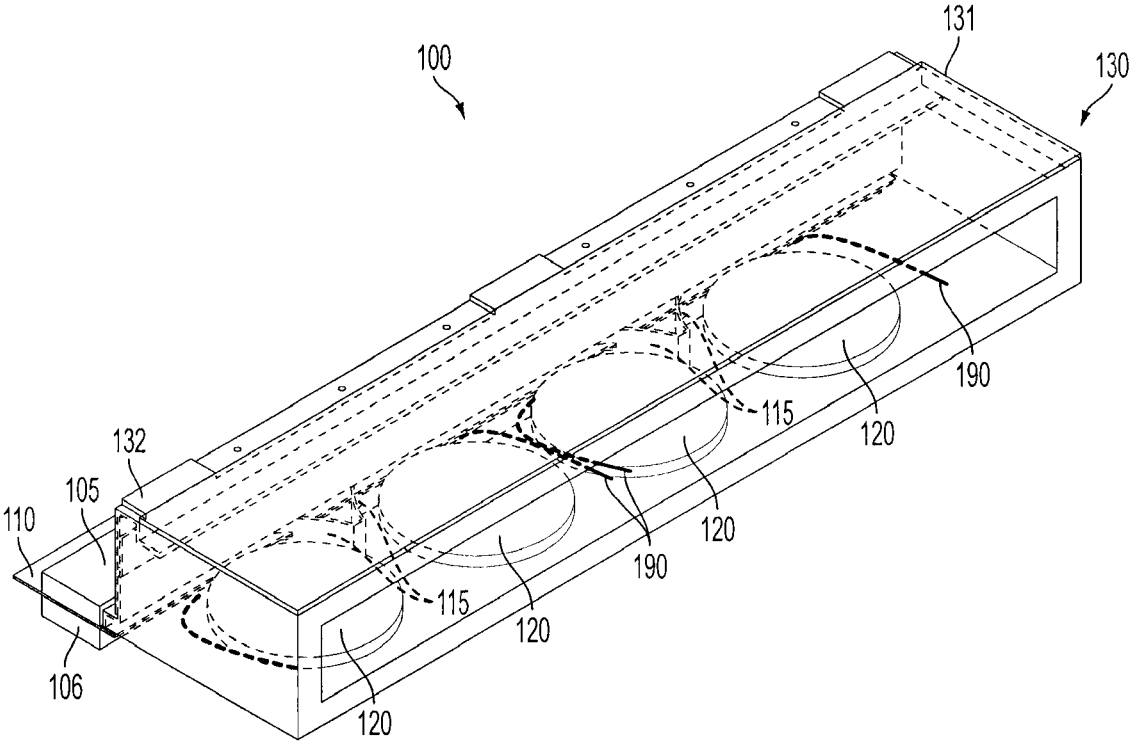
FIG. 1 is a top perspective view of a first embodiment.

FIG. 1 illustrates a perspective view of an exemplary grinder assembly 100 for grinding edges of a glass panel 110. The glass panel 110 is positioned between conveyor belts 105, 106, which move the glass panel 110 past grinder assembly 100. A wheel box 130 is provided around a set of grinder wheels 120. In one embodiment, the wheel box 130 is open at the back to permit access to the motors operating the grinder wheels 120 and to allow for coolant jets 190, which spray coolant onto the grinder wheels 120. In another embodiment, the wheel box 130 is closed on all sides with openings to permit insertion of the coolant jets 190 and spindles for the grinder wheels 120. The wheel box 130 is also provided with an opening to allow the grinder wheels 120 to access the edge of the glass panel 110. The wheel box 130 may be constructed of any suitable material known in the art such as rigid polymers, steel, aluminum, and other metal alloys. In some embodiments, transparent materials such as plexiglass may be used to allow the grinder wheels 120 to be safely observed while in operation. The wheel box 130 serves to contain coolant and debris and protect the glass panel 110 that is being ground.

Figure 2:
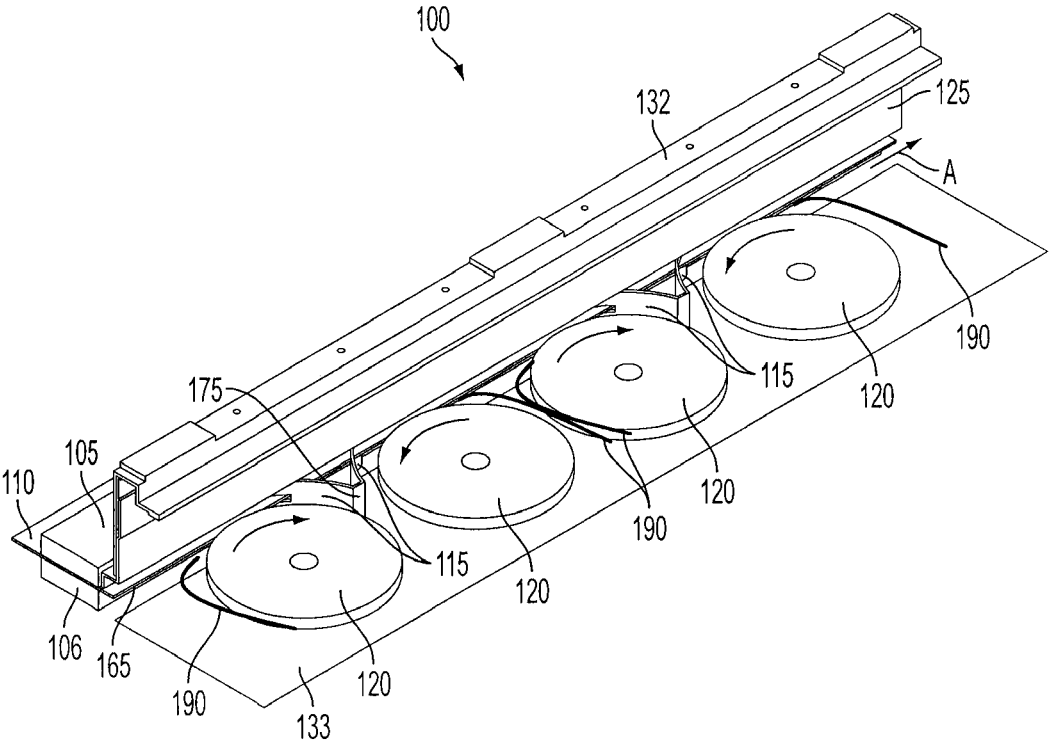
FIG. 2 is a cut-away, top perspective view of the first embodiment.

FIG. 2 shows a partial cut-away view of the grinder assembly 100 of FIG. 1. A fender-type coolant deflector 115 is associated with a corresponding grinder wheel 120 and is utilized to deflect coolant away from conveyor belts 105, 106 and the surface of the glass panel 110. The fender-type coolant deflector 115 is taller than its associated grinder wheel 120. The fender-type coolant deflector 115 is positioned at an angle to the edge 165 of the glass panel 110. In one embodiment, the fender-type coolant deflector 115 has a length such that the distance from the edge 165 of the glass panel 110 to the coolant deflector bridge 175 is between approximately one-half the radius of the grinder wheel 120 and approximately the radius of the grinder wheel 120.

In the embodiment shown in FIG. 2, two opposing fender-type coolant deflectors 115 are positioned between paired sets of grinder wheels 120, which rotate in opposite directions. Coolant jets 190 spray coolant onto the grinder wheels 120 in the direction of the coolant deflectors 115. The grinder wheels 120 then direct the coolant spray towards the coolant deflectors 115. Each coolant deflector 115 thereby serves as a shield between a grinder wheel 120 and the glass panel 110 and prevents the coolant from overflowing onto the glass panel 110 and becoming trapped between the conveyor belts 105, 106 and the glass panel 110.

As is also shown in FIG. 2, a vertical coolant guard 125 may be provided to extend above the coolant deflectors 115. The vertical coolant guard 125 reduces coolant ingress between glass panel 110 and conveyor belts 105, 106. In one embodiment, the coolant deflectors 115 may be welded or otherwise affixed to the coolant guard 125. In another embodiment, the coolant deflectors 115 may be welded or otherwise affixed to bottom plate 133 of the wheel box 130.

FIGS. 1 and 2 also show a top rail 132 of the wheel box 130, which reaches from the top edge of the vertical coolant guard 125 and extends above and partially over the grinder wheels 120 to provide further protection from the overflowing coolant. The top rail 132 is a portion of the frame for the wheel box 130 and provides support to the top lid 131 of the wheel box 130, shown in FIG. 1. The top lid 131 may be made of plexiglass or other similar transparent materials if desired in order to allow the grinder wheels 120 to be observed safely while in operation. The top lid 131 may also be hinged to the top rail 132.

Figure 3:
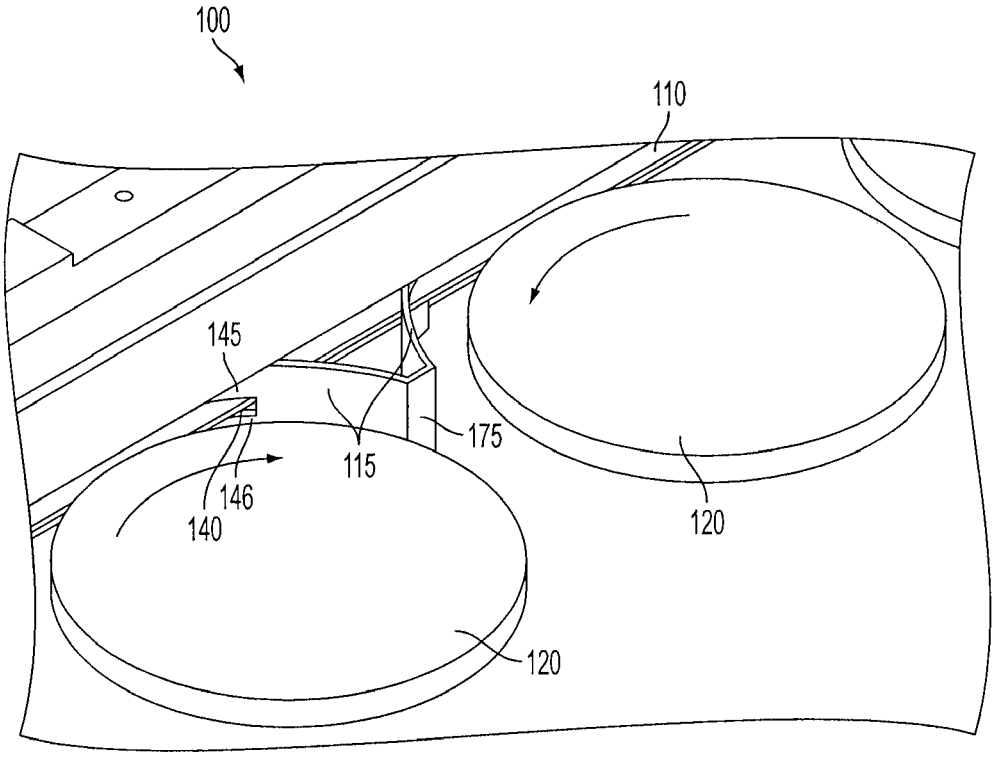
FIG. 3 is a close-up, top perspective view of FIG. 2.

FIG. 3 shows a close up of the grinder assembly 100 of FIG. 2. The coolant deflector 115 is provided with upper and lower tabs 145, 146 that define a notch 140 between them. The notch 140 is configured such that the edge of the glass panel 110 fits within the notch 140. The upper and lower tabs 145, 146 extend above and below the glass panel 110 to reduce coolant ingress between the glass panel 110 and conveyor belts 105, 106.

As is shown in FIG. 3, the fender-type coolant deflectors 115 are formed as opposing arcs spaced from the grinder wheels 120 and concentric with the grinder wheels 120. In this embodiment, the opposing fender-type coolant deflectors 115 are connected by a coolant deflector bridge 175. Depending on the distance between adjacent grinder wheels 120 and the desired distance between the coolant deflector 115 and the grinder wheel 120, this element may be omitted and the coolant deflectors 115 connected directly.

Figure 3A:
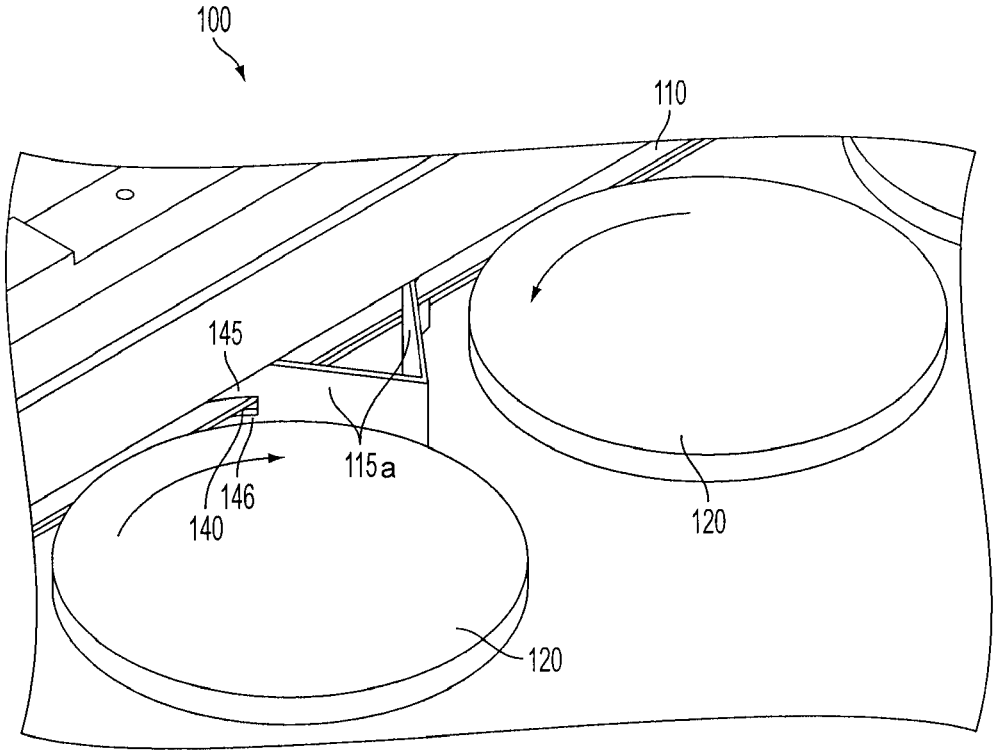
FIG. 3A is a close-up, top perspective view of a second embodiment.
Figure 3B:
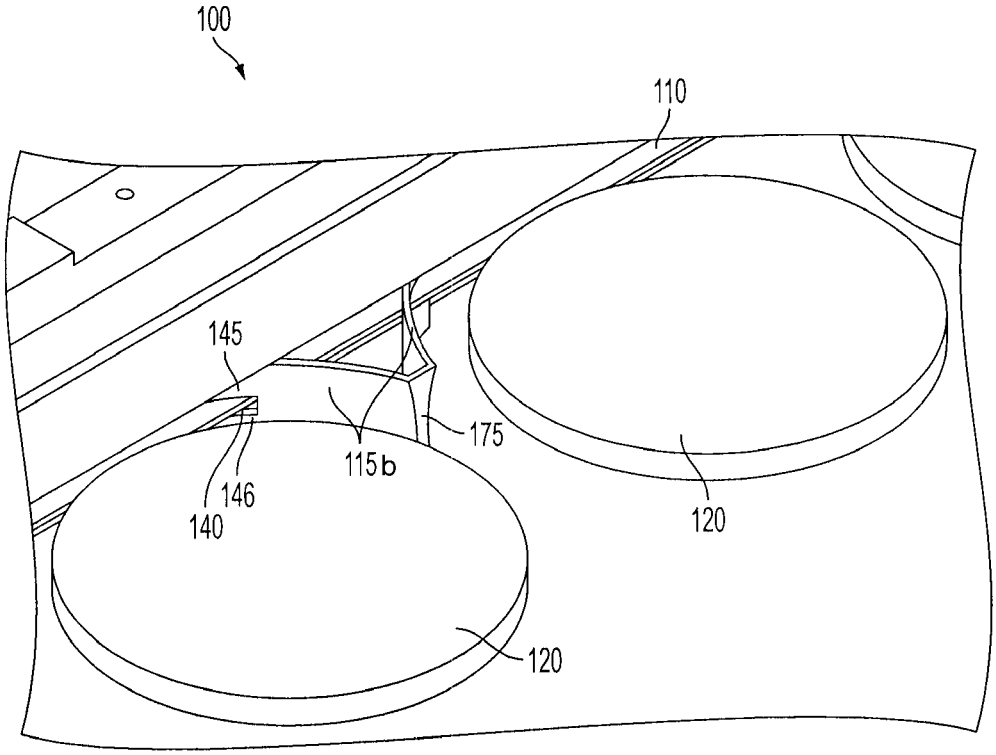
FIG. 3B is a close-up, top perspective view of a third embodiment.
Figure 3C:
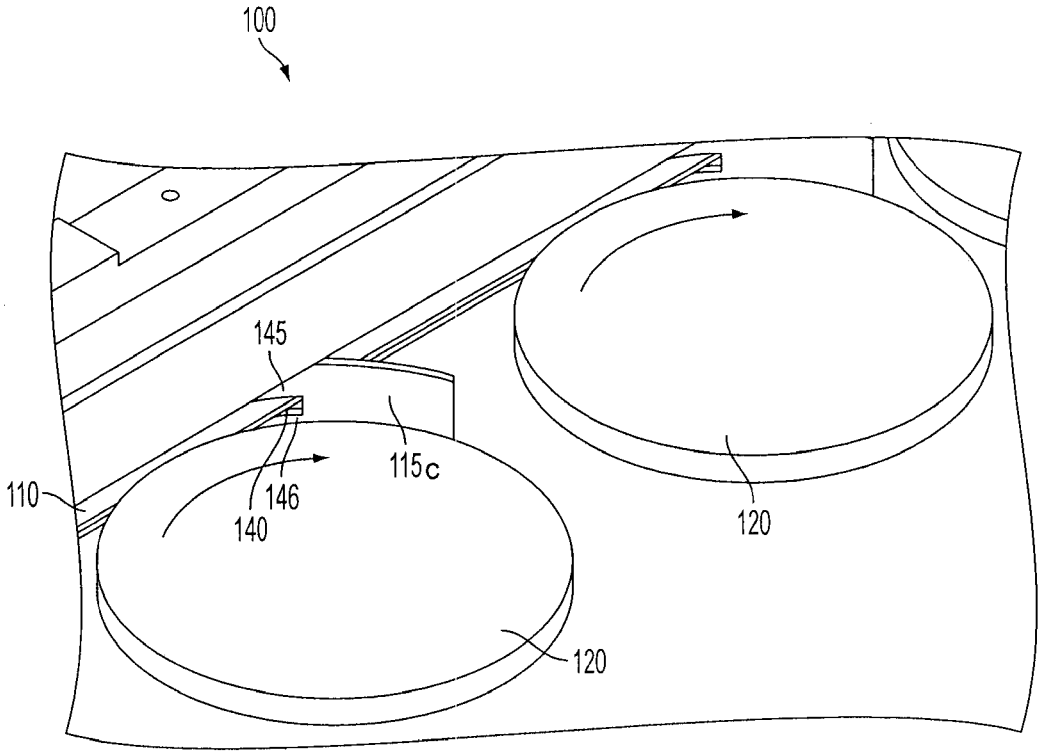
FIG. 3C is a close-up, top perspective view of a fourth embodiment.

In another embodiment, shown in FIG. 3A, the fender-type coolant deflector 115*a* may be shaped as a flat plate and spaced parallel to a tangent of the circular grinder wheels 120. In another embodiment, shown in FIG. 3B, the fender-type coolant deflector 115*b* is arced to be both concentric to the grinder wheel 120 and have a top edge and bottom edge that arc and extend toward the top surface and bottom surface of the grinder wheel 120 respectively to further shield the glass panel 110 and conveyor belts 105, 106 from the coolant. In another embodiment, shown in FIG. 3C, the grinder wheels rotate in the same direction and only one fender-type coolant deflector 115*c* is positioned between any two grinding wheels. In this embodiment, the fender-type coolant deflector 115*c* may be shaped in any of the forms described above.

The diameter of the wheels of the grinder assembly 100 is dependent upon the size and configuration of the glass panels to be ground. The fender-type coolant deflectors 115, 115*a*, 115*b*, 115*c* are proportioned relative to the size grinder wheels 120 utilized and of a sufficient height and length to deflect coolant spray as described herein. The coolant deflectors 115, 115*a*, 115*b*, 115*c* may be manufactured from any suitable material known in the art including suitably rigid polymers, steel, aluminum, and other metal alloys.

The conveyor belts 105, 106 shown in FIG. 2 are configured to move the glass panel 110 continuously in the direction of arrow A past the grinder wheels 120. A second grinder assembly 100 may be used to simultaneously grind the edge parallel to the edge that is being ground in FIG. 2.

An additional set of grinder assemblies 100 may be provided at a second grinding station. The additional set of grinders may be used to simultaneously grind the remaining two parallel sides of the glass panel. If other shaped glass panels 110 are utilized, an additional grinder assembly 100 may be provided for each additional side to be ground.

Figure 4:
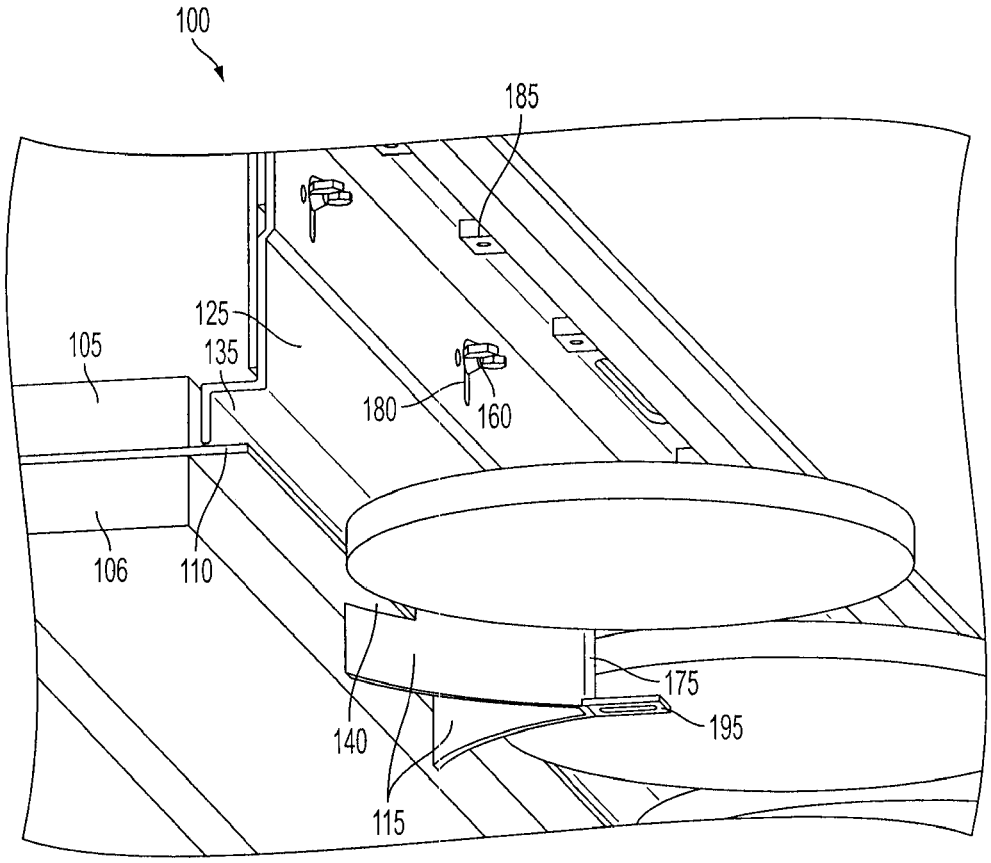
FIG. 4 is a cut-away, bottom perspective view of the first embodiment.

FIG. 4 shows a cut-away, bottom perspective view of the grinder assembly 100 in which the bottom plate 133, shown in FIG. 2, and spindles of the grinder wheels 120 are omitted. In one embodiment, the coolant guard 125 may be provided with vertical slots 180 through which a bolt and wing nut 160 or similar fastener fixes the coolant guard 125 to the top rail 132 portion of the wheel box 130. The vertical slots 180 allow the coolant guard 125 and associated deflector 115 to be raised or lowered as desired to adjust a desired clearance between the coolant guard 125, deflector 115, and the glass panel 110.

As is also shown in FIG. 4, the coolant guard 125 may be provided with a channel 135 such that the coolant guard 125 has a "step" immediately above the glass panel 110. The channel 135 provides stability to the coolant deflectors 115, while still providing the grinder wheels 120 with access to the glass panel 110. This also provides a location for the coolant deflector 115 to be mounted to the coolant guard 125.

Figure 5:
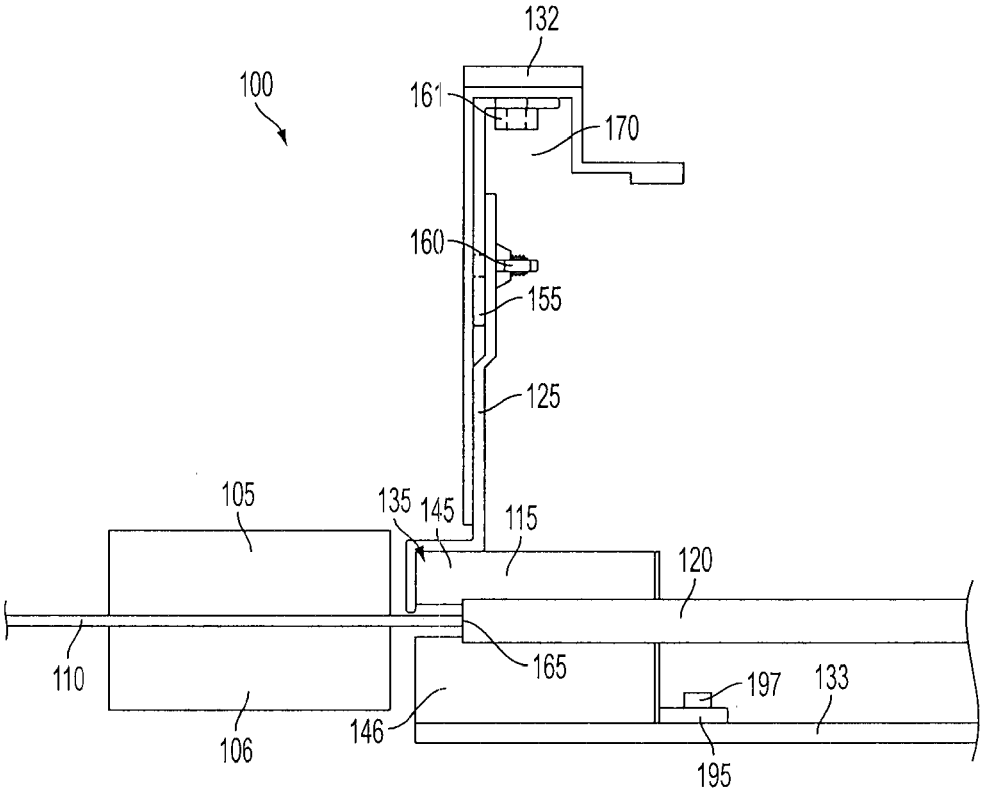
FIG. 5 is a cut-away, side view of the first embodiment.

FIG. 5 shows the coolant deflector of FIG. 4 from a side view. As is shown in FIGS. 4 and 5, the coolant deflectors 115 of FIG. 2 may be mounted to the bottom plate 133. To facilitate this, a bracket 195 is provided with a slot for a bolt 197 to mount the coolant deflector 115 to the bottom plate 133 of the wheel box 130. This enables the coolant deflector 115 to be used without the coolant guard 125 if desired, or to allow the coolant deflector 115 to be easily exchanged with a differently configured coolant deflector 115 as desired.

The coolant guard 125 may be manufactured from any suitable material known in the art including rigid polymers, steel, aluminum, and other metal alloys. The coolant guard 125 may be manufactured from the same material as the coolant deflectors 115, 115*a*, 115*b*, 115*c* or from different materials as desired.

As is also shown in FIG. 5, opposing tabs 145, 146 of the coolant deflector 115 extend above and below the glass panel 110 to provide protection from coolant ingress between the belts 105, 106 and the glass panel 110. The channel 135 of the coolant guard 125 is configured to receive the upper tab 145 of the coolant deflector 115, and the upper tab 145 can be welded or mechanically fastened thereto. In another embodiment, the coolant deflector 115 can be formed such that the coolant deflector 115 is unitary with the coolant guard 125. In one embodiment, a nut 161 may be welded within a channel 170 provided in the top rail 132. This nut 161 provides an anchor location for a hinge with which to mount the top lid 131 of the wheel box 130.

Figure 6:
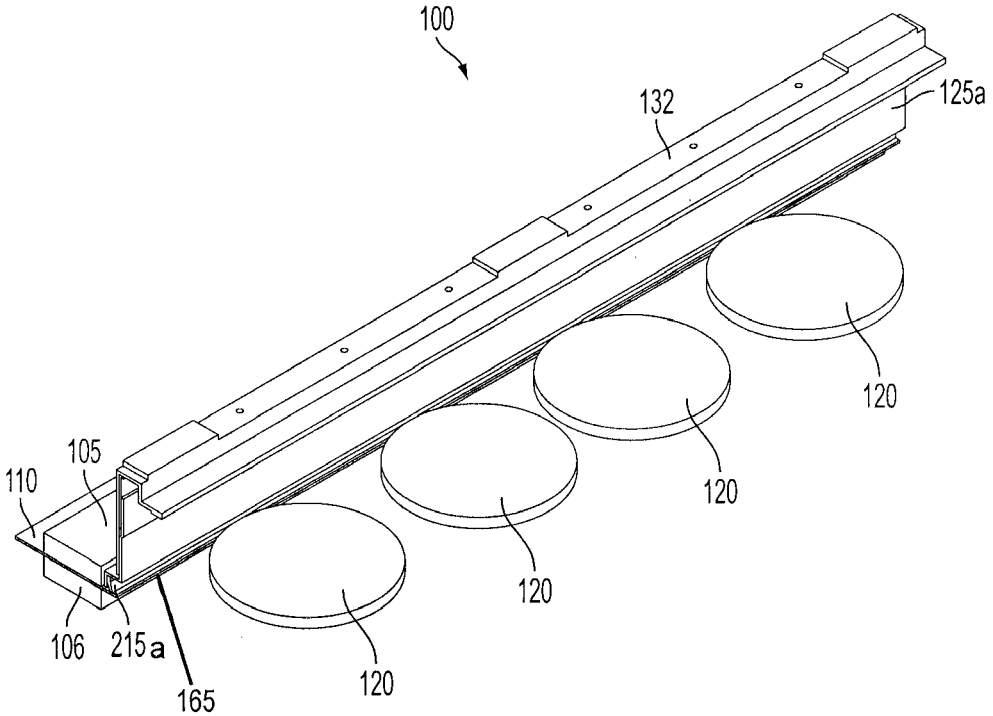
FIG. 6 is a cut-away, top perspective view of a fifth embodiment.

FIG. 6 shows a grinder assembly 100 from a top perspective view of another embodiment. In this embodiment, the coolant deflector is provided as a wiper-type coolant deflector 215*a* to prevent coolant from entering between the conveyor belts 105, 106 and the glass panel 110. The wiper-type coolant deflector 215*a* is preferably made of flexible material. Nonetheless, it may be made of non-flexible material. The material from which the wiper-type coolant deflector 215*a* may be made includes ultra-high-molecular-weight polyethylene (UHMW), polyoxymethylene (Delrin), and silicone as well as other polymers. The wiper may have a thickness between 0.025 and 0.035 inches.

Figure 7:
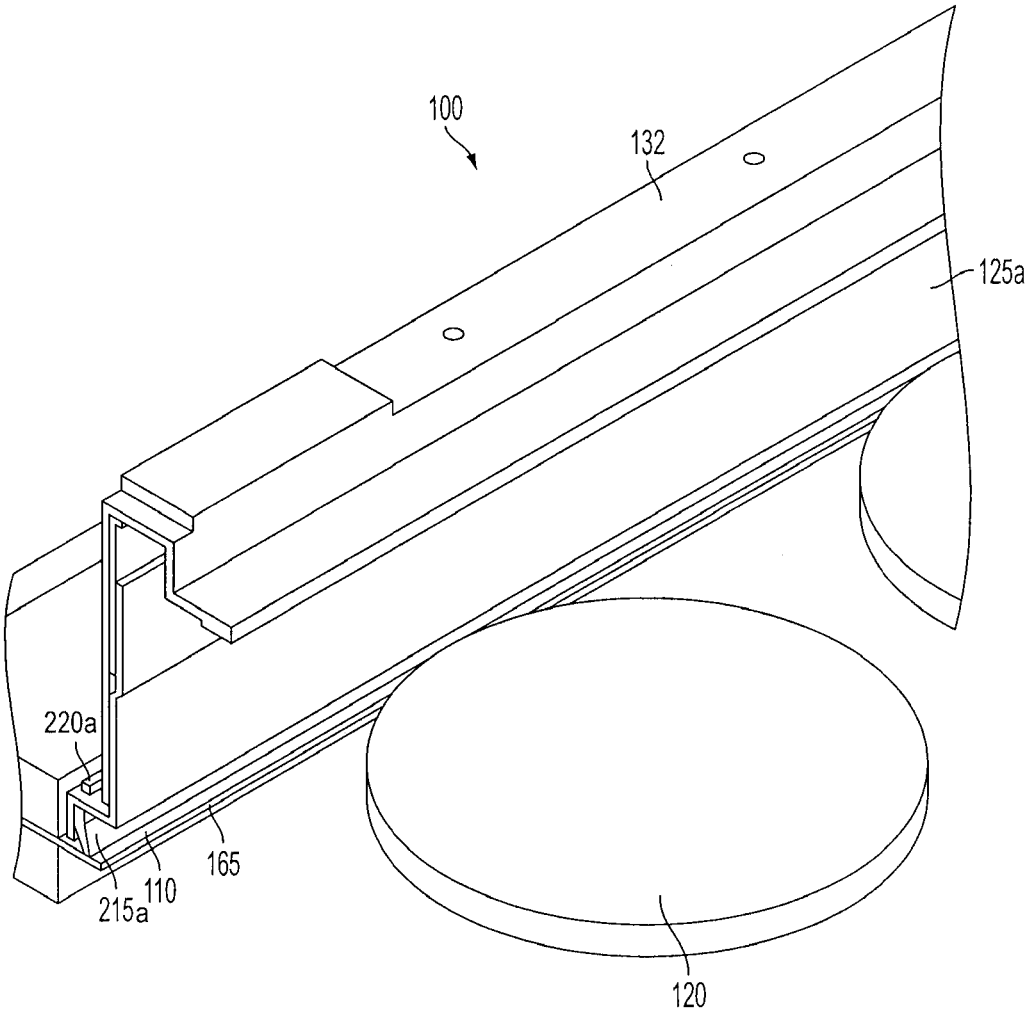
FIG. 7 is a close-up, cut-away, top perspective view of the fifth embodiment.

FIG. 7 shows a partial close up view of the grinder assembly 100 of FIG. 6. As is shown in FIGS. 6 and 7, the blade of the wiper-type coolant deflector 215*a* is against the surface of the glass panel 110 to stop the flow of coolant over the conveyor belts 105 and 106 and the glass panel 110.

Figure 8:
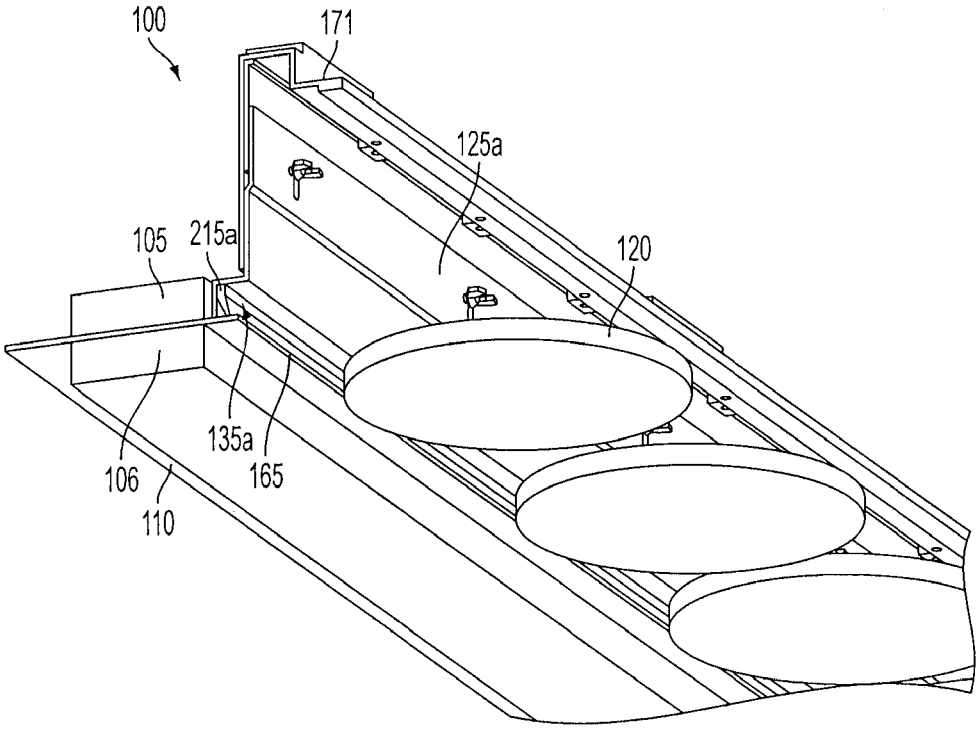
FIG. 8 is a cut-away, bottom perspective view of the fifth embodiment.

As can be better seen in FIG. 8, showing the wiper-type coolant deflector 215*a* from a bottom perspective view, coolant guard 125*a* has a "step" which defines a channel 135*a* at the edge 165 of the glass panel 110. The wiper-type coolant deflector 215*a* may be mounted to the channel 135*a* of the coolant guard 125*a* at the edge 165 of the glass panel 110. The wiper-type coolant deflector 215*a* is positioned to maintain contact with the glass panel 110 while providing minimal frictional resistance.

Figure 9:
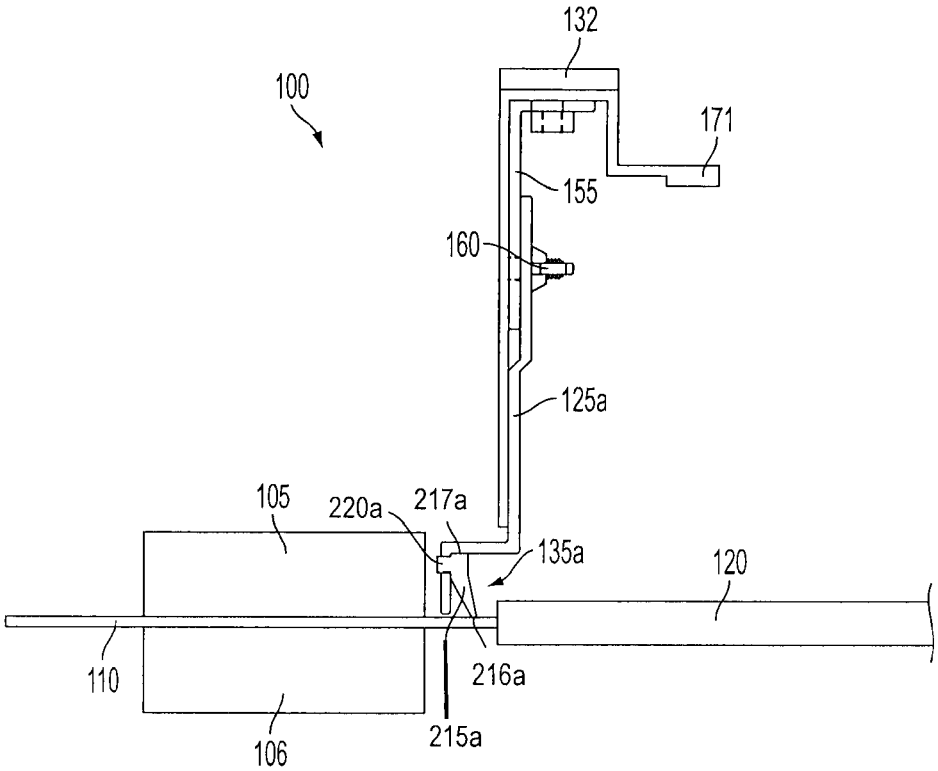
FIG. 9 is a cut-away, side view of the fifth embodiment.

FIG. 9 shows an end view of the grinder assembly 100 of FIG. 6. In the embodiment of FIG. 9, the wiper-type coolant deflector 215*a* is mechanically fixed to the coolant guard 125*a*. This may be accomplished by providing a tab 220*a*, shown in FIGS. 7 and 9, that clips into a mating slot in the coolant guard 125*a* to affix the wiper-type coolant deflector 215*a* to the coolant guard 125*a*. In another embodiment, the top rail 132 of FIG. 9 may be configured to mount to a bracket 155 and provide a rest area 171 to receive the top lid 131, shown in FIG. 1, which prevents the top lid 131 from sliding around the top of the wheel box 130.

In one embodiment also shown in FIG. 9, the wiper-type coolant deflector 215*a* tilts away from the grinder wheel 120 such that the linear distance between the edge 216*a* contacting the glass panel 110 and the grinder wheel 120 is less than the linear distance between the edge 217*a* fixed to the coolant guard 125*a* and the grinder wheel 120. By using this configuration, the force of the coolant spray from the grinder wheels 120 acts to force the edge 216*a* of the wiper-type coolant deflector 215*a* against the glass panel 110. This creates a more effective seal between the wiper-type coolant deflector 215*a* and the glass panel 110, which reduces coolant ingress between the glass panel 110 and the conveyor belts 105, 106.

Figure 9A:
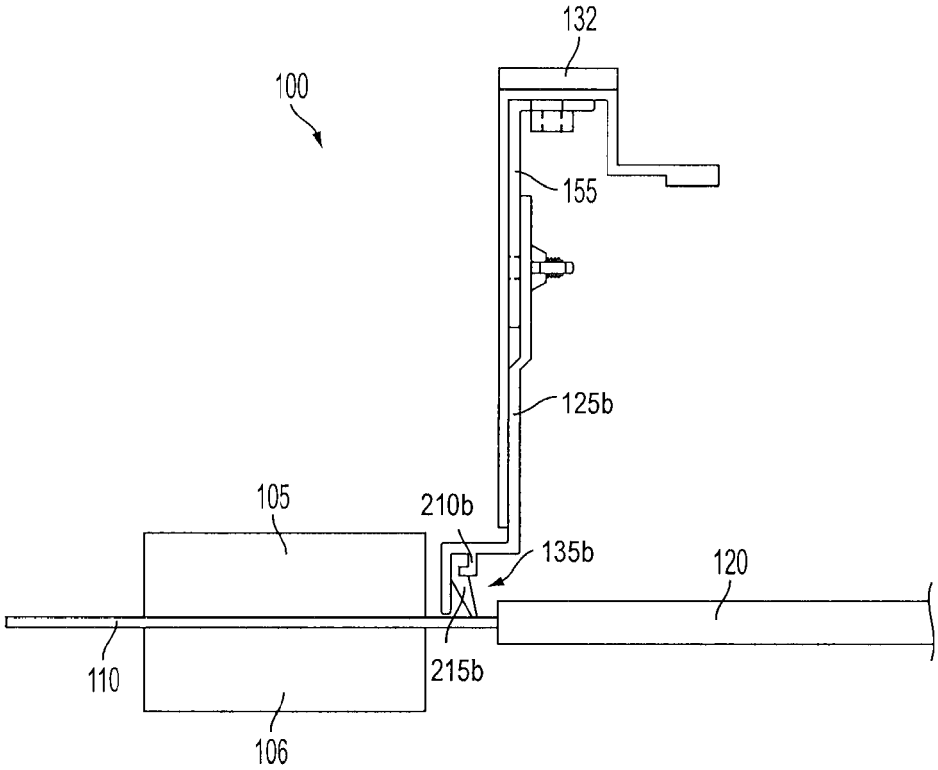
FIG. 9A is a cut-away, side view of a sixth embodiment.
Figure 9B:
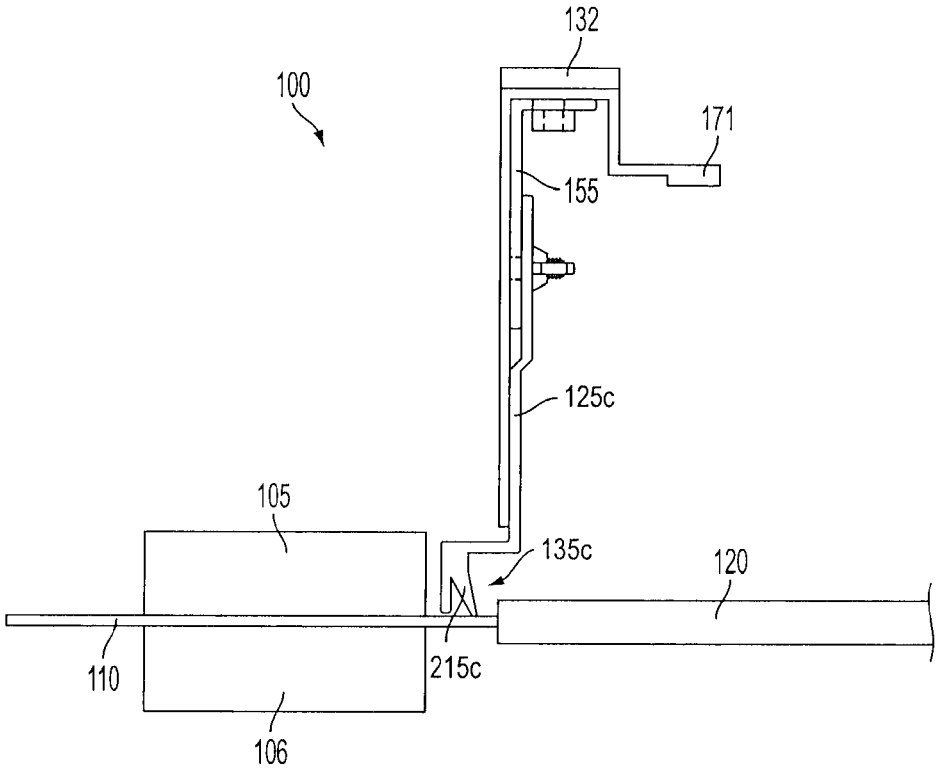
FIG. 9B is a cut-away, side view of a seventh embodiment.

In another embodiment, shown in FIG. 9A, the wiper-type coolant deflector 215*b* may be provided with a tab along its length configured to slide into a groove 210*b* on the coolant guard 125*b*. In this embodiment, one end of the groove 210*b* is closed such that the frictional force of the glass panel 110 against the wiper-type coolant deflector 215*b* does not slide the wiper-type coolant deflector 215*b* out of the groove 210*b*. In another embodiment, shown in FIG. 9B, the wiper-type coolant deflector 215*c* may be formed unitary with the coolant guard 125*c*. In another embodiment, the wiper-type coolant deflector 215*a* is fixed to coolant guard 125*a* by a suitable, water-resistant adhesive.

As is also shown in FIG. 9, the wiper-type coolant deflector 215*a* is provided on only the top side of the glass panel 110. In another embodiment, shown in FIG. 9C, the wiper-type coolant deflector 215*a* may be provided on the top and bottom sides of the glass panel 110 or one wiper-type coolant deflector 215*a* may be provided on only the bottom side of the glass panel 110.

FIG. 9 also shows that the coolant guard 125*a* is positioned such that it extends substantially perpendicular to the plane of the glass panel 110. In another embodiment shown in FIG. 9D, the coolant guard 125*d* is positioned such that it tilts toward the conveyor belts 105, 106. In a third embodiment, shown in FIG. 9E, the coolant guard 125*e* is positioned such that it is tilted away from the conveyor belts 105, 106 and reaches over the grinder wheels 120.

Figure 10:
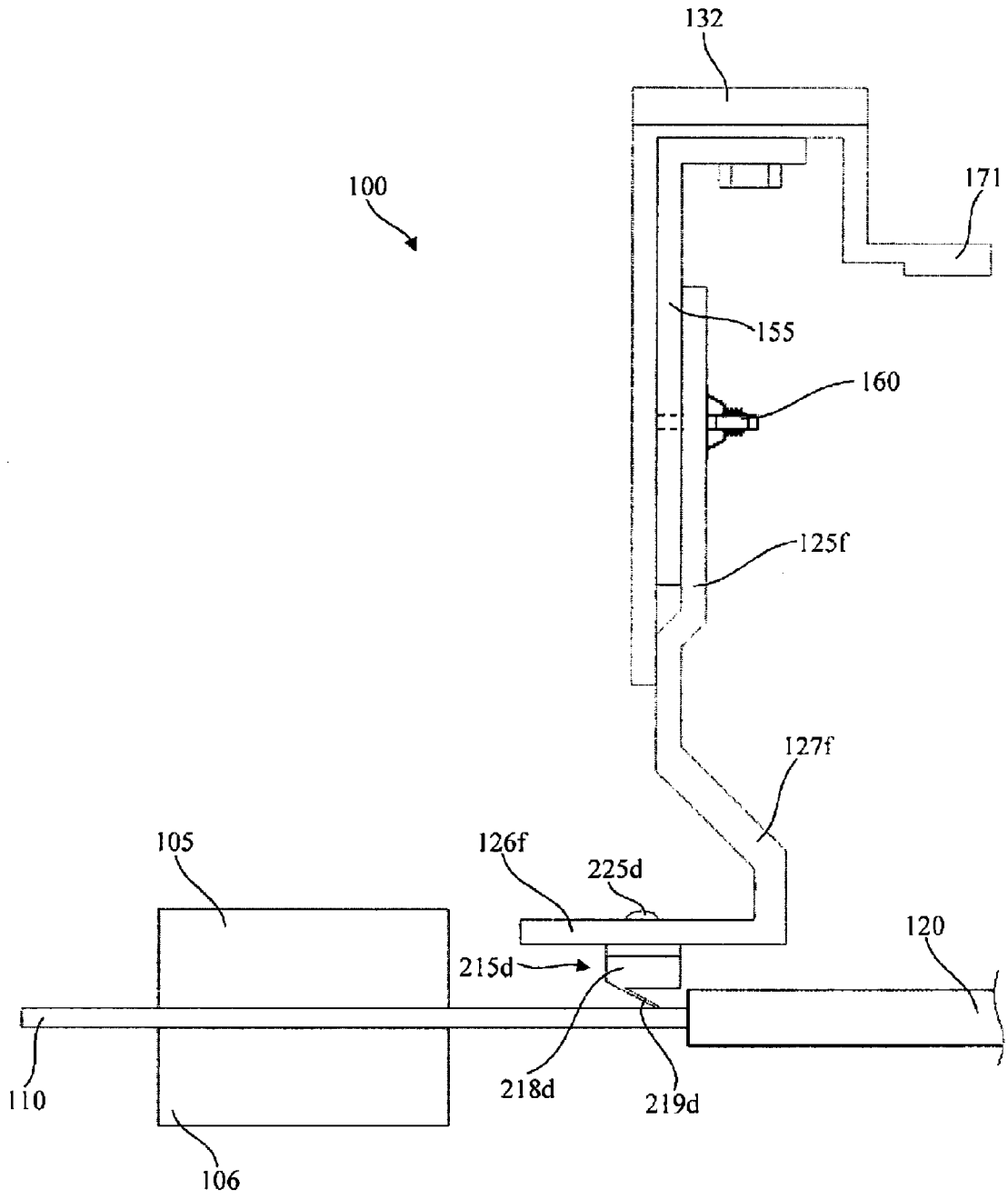
FIG. 10 is a cut-away, side view of an eleventh embodiment

FIG. 10 shows a side perspective of a coolant guard 125*f* and wiper-type coolant deflector 215*d* according to another embodiment. In this embodiment, the coolant guard 125*f* does not include the channel 135*a*, and the wiper-type coolant deflector 215*d* is affixed to a bottom landing 126*f* of the coolant guard 125*f*. The wiper-type coolant deflector 215*d* is also configured differently to allow it to be affixed by a fastener 225*d* inserted through a slot in the bottom landing 126*f* and into the wiper-type coolant deflector 215*d*. The wiper-type coolant deflector 215*d* is made of a sturdy upper threaded element 218*d* that will hold the wiper-type coolant deflector 215*d* in place and a lower wiper element 219*d* that is configured to ride along the glass panel 110 and prevent coolant from flowing over the glass surface 110.

In one embodiment, to allow the wiper-type coolant deflector 215*d* to be positioned as close to the grinder wheel 120 as possible to protect more of the glass panel 110 surface, the coolant guard 125*f* may be provided as an angled portion 127*f*.

Figure 11:
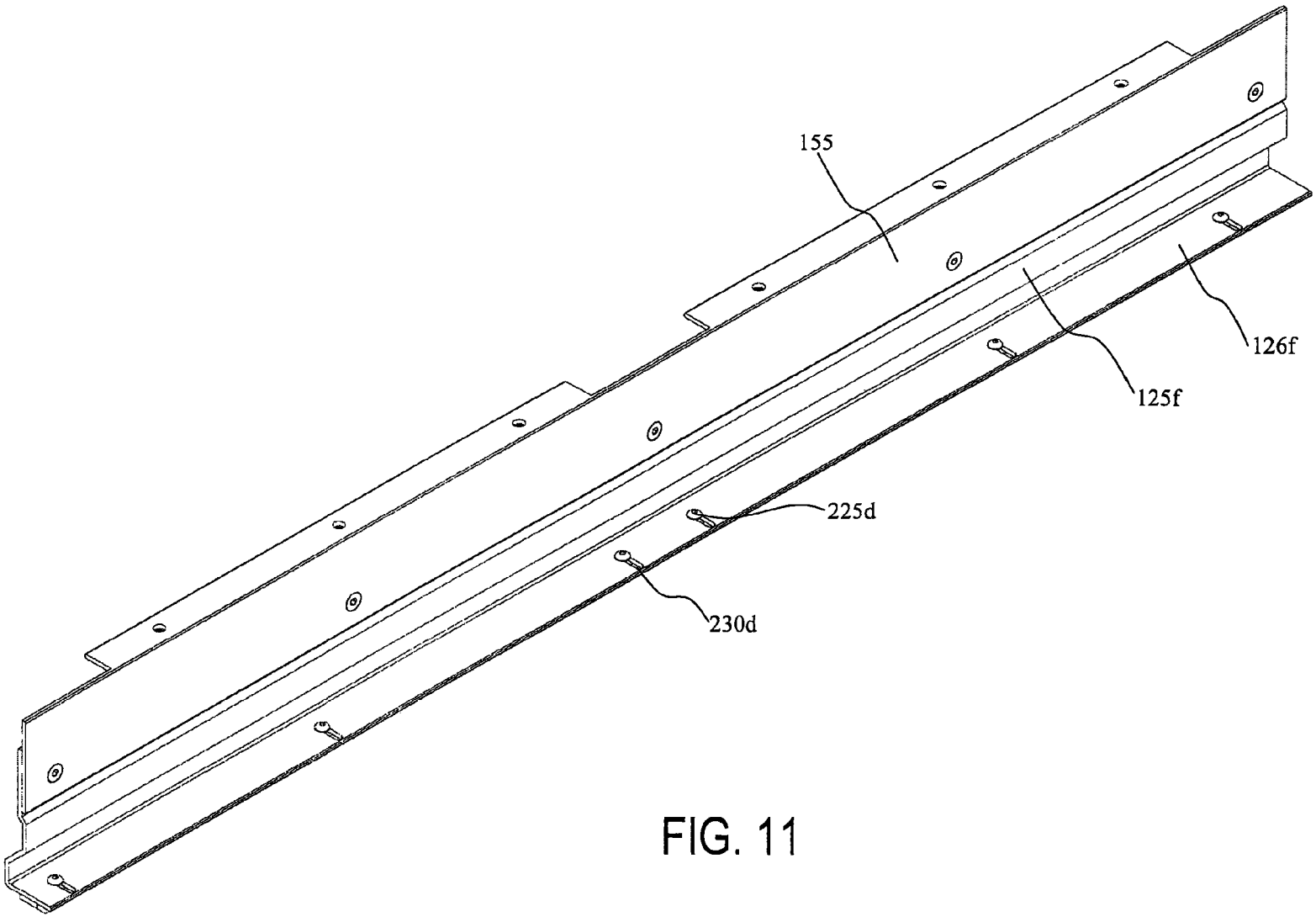
FIG. 11 is a cut-away, top perspective of the eleventh embodiment.

As is shown in FIG. 11 from a top perspective view of the coolant guard 125*f* of FIG. 10 from the conveyor side, the bottom landing 126*f* of the coolant guard 125*f* may be provided with a slot 230*d* to correspond to each fastener 225*d*. This allows an operator to adjust the distance between the edge of the glass panel and grinder wheel 120 as desired.

Figure 12:
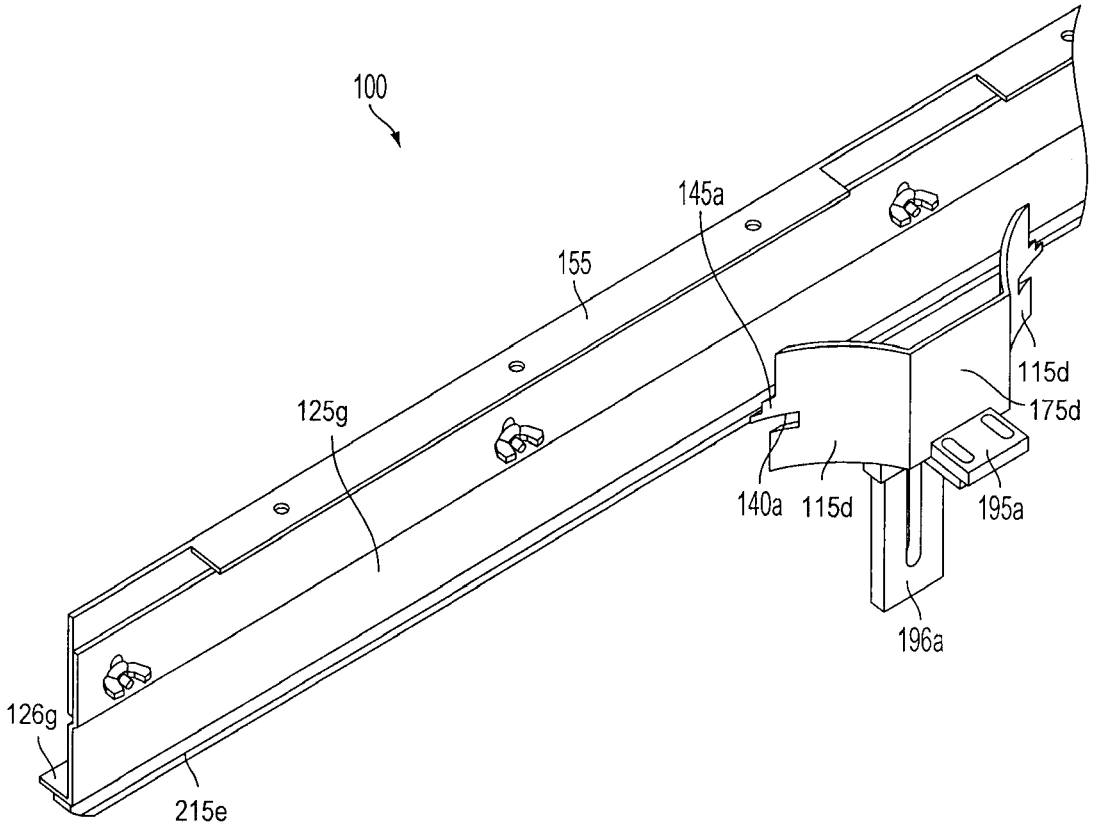
FIG. 12 is a cut-away, top perspective view of a twelfth embodiment.

As is shown in the top perspective view of FIG. 12, fender-type coolant deflectors 115*d* and wiper-type coolant deflectors 215*e* may be both utilized to reduce coolant and abrasive particle ingress. In this embodiment, the fender-type coolant deflectors 115*d* are provided with two brackets 195*a*, 196*a*, which can be mounted to the top surface and side of the bottom plate 133 of the wheel box 130 of FIG. 2. As can be seen in FIG. 12, the brackets 195*a*, 196*a* may be provided with slots that permit the fender-type coolant deflectors 115*d* to be adjusted vertically or horizontally. The fender-type coolant deflectors 115*d* may also be welded or otherwise mechanically attached to the coolant guard 125*g*.

In the embodiment shown in FIG. 12, the channel 135*a* discussed above is omitted. In this embodiment, a wiper-type coolant deflector 215*e* is provided. The coolant guard 125*g* is bent in at a 90° angle to create a bottom landing 126*g* and define a clearance between the glass panel being ground and the coolant guard 125*g*. The wiper-type coolant deflector 215*e* may be affixed to the coolant guard 125*g* in any of the manners discussed above. A bracket 155 is also provided to couple the coolant guard 125*g* to the wheel box 130 of FIG. 1.

Figure 9C:
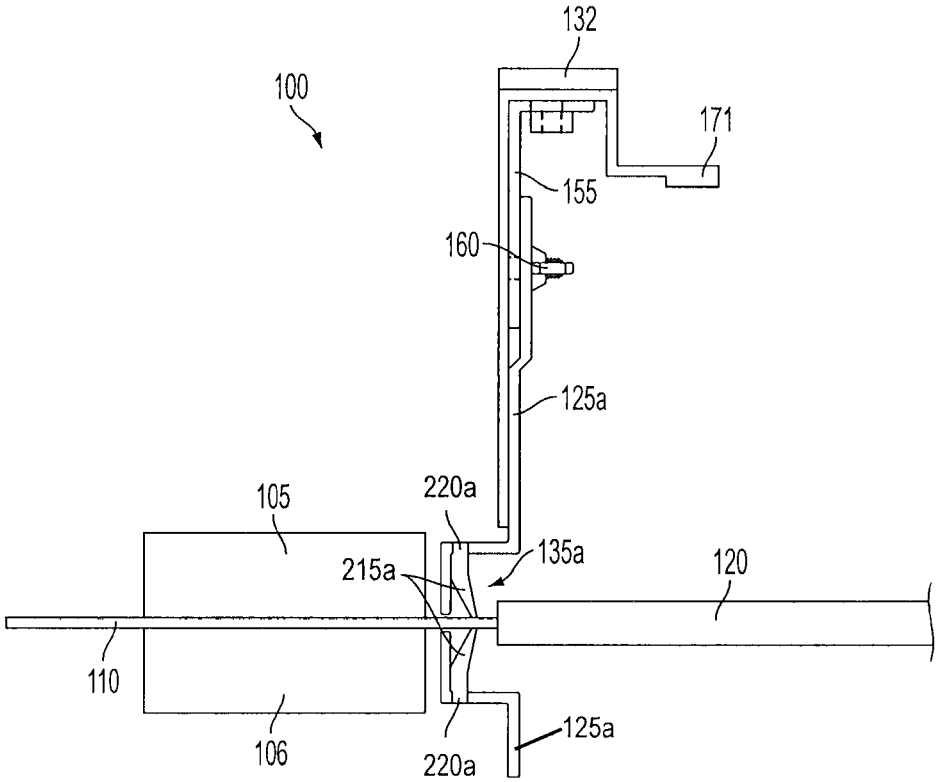
FIG. 9C is a cut-away, side view of an eighth embodiment.
Figure 9D:
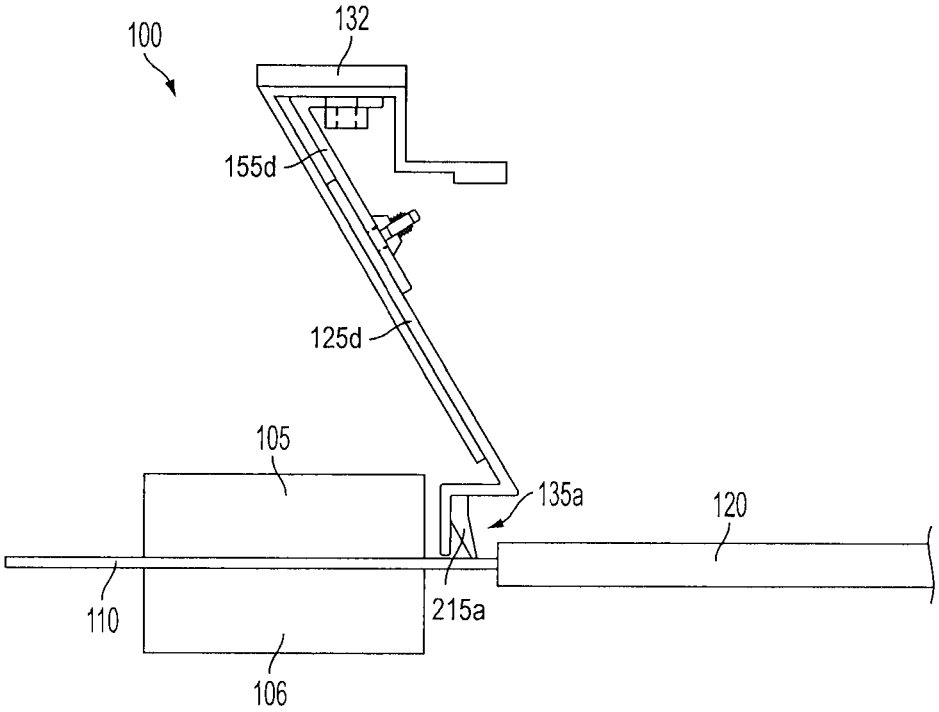
FIG. 9D is a cut-away, side view of a ninth embodiment.
Figure 9E:
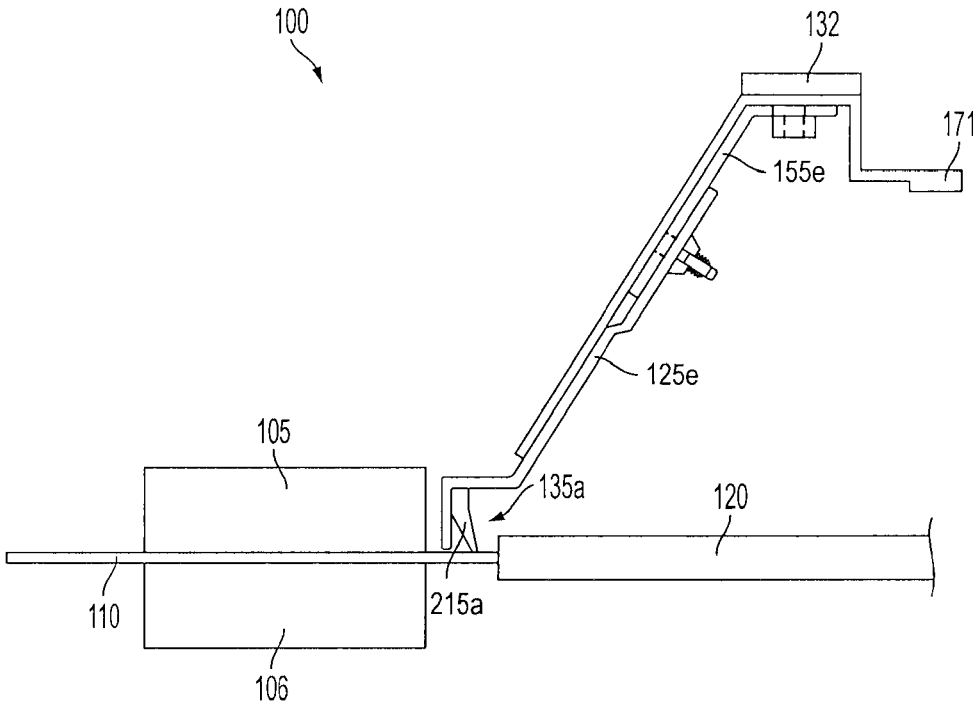
FIG. 9E is a cut-away, side view of a tenth embodiment.
Figure 13:
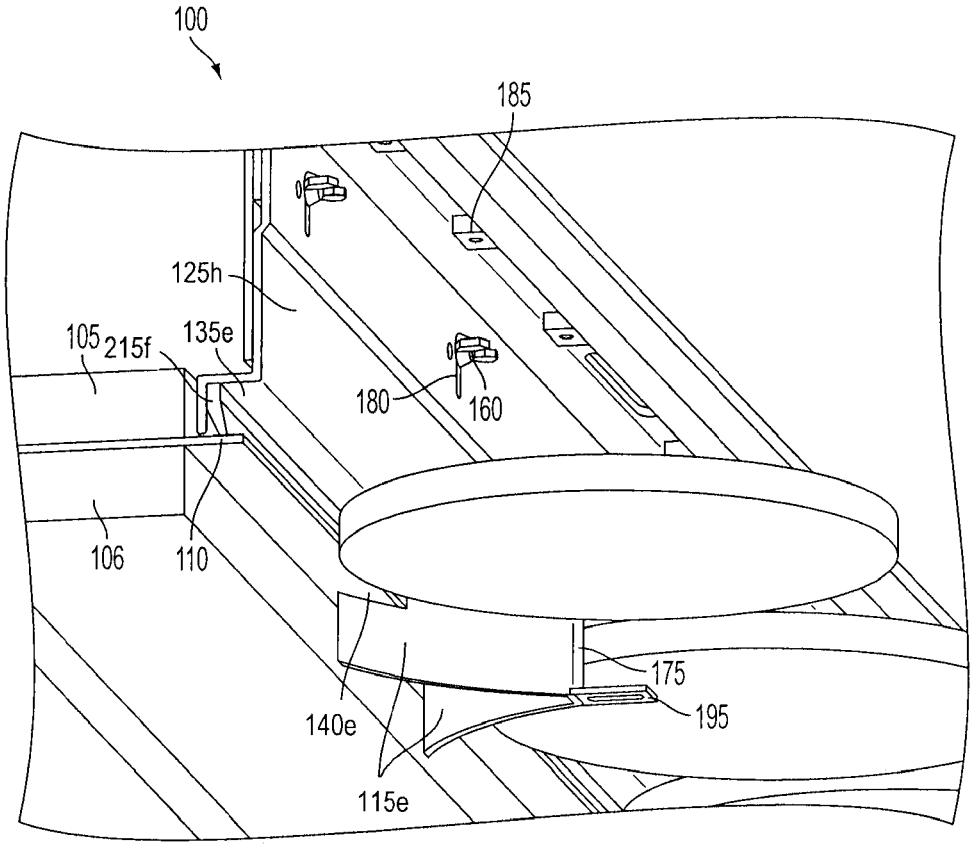
FIG. 13 is a cut-away bottom perspective view of a thirteenth embodiment.
Figure 14:
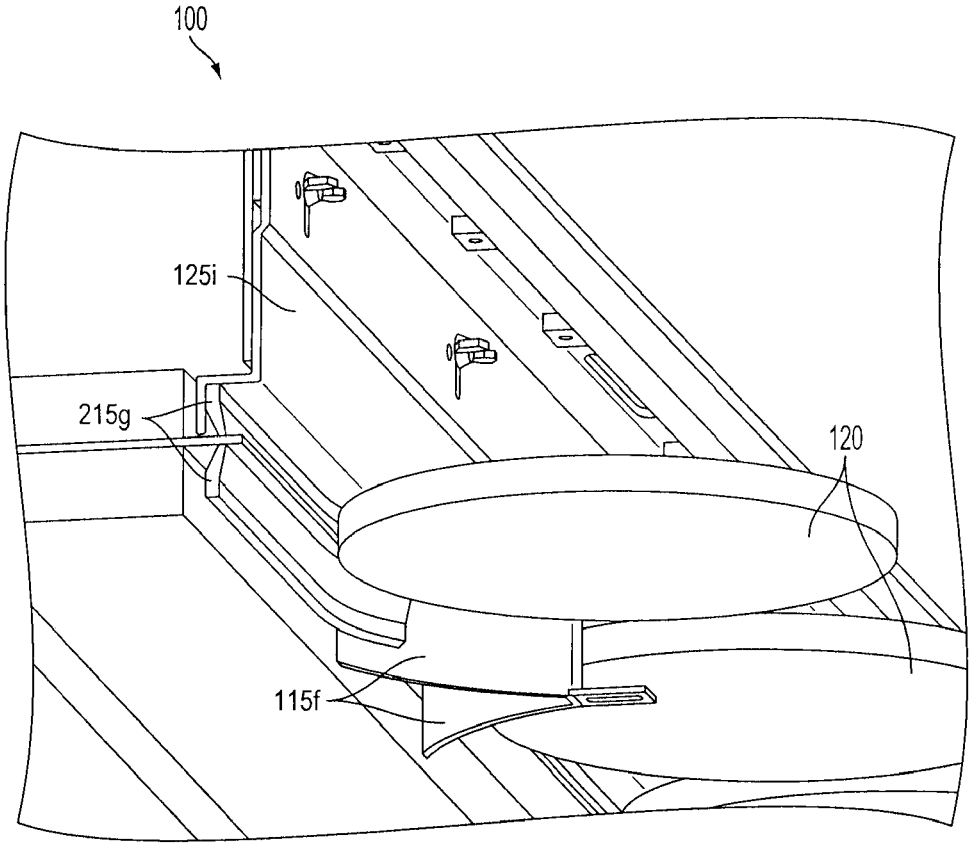
FIG. 14 is a cut-away bottom perspective view of a fourteenth embodiment.

In another embodiment, shown in FIG. 13, the coolant guard 125*h* of the grinder assembly 100 may be provided with both a fender-type coolant deflector 115*e* and a wiper-type coolant deflector 215*f* to reduce coolant ingress. In another embodiment, shown in FIG. 14, the wiper-type coolant deflector 215*g* may also be affixed adjacent to the notch 140*e* on the top and bottom of the glass plate 110 to increase the effectiveness of the fender-type coolant deflector 115*f*. In this embodiment, the wiper-type coolant deflector 215*g* is segmented and each segment is curved as shown in order to reduce coolant ingress through the notch 140*e* shown in FIG. 13. The lower coolant guard, shown in FIG. 9C, is omitted in FIG. 14.

While various embodiments have been described herein, various modifications and changes can be made. Accordingly, the disclosed embodiments are not to be considered as limiting as the invention is defined solely by the scope of the appended claims.

What is claimed is:

1. An apparatus for grinding a side edge of a panel, the apparatus comprising:

at least one grinder wheel positioned to grind the side edge of the panel;

a coolant device configured to supply a coolant to the grinder wheel;

a conveying mechanism configured to convey the panel such that the side edge of the panel can be ground by the grinder wheel;

a coolant guard interposed between the conveying mechanism and the grinder wheel and extending collinearly in a direction of the side edge of the panel being conveyed;

a first coolant deflector positioned between the coolant device and the coolant guard and configured to block coolant from contacting the conveying mechanism; and a first wiper affixed to the coolant guard between the coolant guard and the grinding wheel and extending collinearly in a direction of the side edge of the panel being conveyed along the conveying mechanism such that a transported panel contacts the first wiper.

2. The apparatus according to claim 1, wherein the first coolant deflector comprises a plate.

3. The apparatus according to claim 2, wherein the plate comprises an arcuate shape and is positioned adjacent the grinder wheel such that the arcuate shape is substantially concentric with the grinder wheel.

4. The apparatus according to claim 2, wherein the plate comprises a planar shape and is positioned adjacent the grinder wheel such that the coolant deflector is parallel to a line tangent to the grinder wheel.

5. The apparatus according to claim 1, wherein a distance between the first wiper and the at least one grinder wheel is adjustable.

6. The apparatus according to claim 1, wherein the first wiper comprises a fastener inserted into the coolant guard to affix the first wiper to the coolant guard.

7. The apparatus according to claim 1, wherein the coolant guard comprises a groove and the first wiper comprises a tab configured to be retained in the groove.

8. The apparatus according to claim 1, wherein the first wiper comprises a first edge arranged to contact a transported panel and a second edge affixed to the coolant guard, wherein a linear distance between the first edge and the grinder wheel is less than a linear distance between the second edge and the grinder wheel.

9. The apparatus according to claim 1, further comprising a second wiper, and wherein the first wiper contacts an upper surface of the transported panel and the second wiper contacts a lower surface of the transported panel.

10. The apparatus according to claim 9, wherein the first and second wipers are positioned parallel to an edge of the transported panel.

11. The apparatus according to claim 1, wherein the first wiper is positioned parallel to an edge of the transported panel.

12. The apparatus according to claim 1, wherein the first coolant deflector is formed integral with the coolant guard.

13. The apparatus according to claim 1, wherein the first coolant deflector is affixed to the coolant guard.

14. The apparatus according to claim 1, further comprising a wheel box, wherein the wheel box comprises a frame, a lid, a bottom plate, and enclosed on at least two sides, wherein the wheel box contains the grinder wheel.

15. The apparatus according to claim 1, further comprising a second coolant deflector.

16. The apparatus according to claim 1, wherein the first wiper comprises a thickness of between 0.025 and 0.035 inches.

17. An apparatus for grinding a side edge of a panel, the apparatus comprising:

at least one grinder wheel positioned to grind the side edge of the panel;

a coolant device for supplying a coolant to the grinder wheel;

a conveying mechanism for conveying the panel such that the side edge of the panel can be ground by the grinder wheel;

a first coolant deflector comprising a plate for blocking coolant from contacting the conveying mechanism;

a coolant guard mounted adjacent the first coolant deflector and interposed between the conveying mechanism and the grinder wheel; and a first wiper affixed to the coolant guard and extending along the conveying mechanism such that a transported panel contacts the first wiper;

wherein the plate comprises a top edge and a bottom edge and is arced from the top edge to the bottom edge such that the top edge extends toward a top surface of the grinder wheel and the bottom edge extends toward a bottom surface of the grinder wheel.

18. The apparatus according to claim 1, wherein the first coolant deflector comprises a first tab, a second tab, and a notch, further wherein the first and second tabs define the notch and the coolant deflector is configured such that a transported panel passes through the notch.

19. The apparatus according to claim 18, wherein the coolant guard comprises a channel configured to receive the first tab.

20. The apparatus according to claim 18, wherein the first wiper is provided adjacent to the notch.

21. The apparatus according to claim 1, wherein the coolant guard is substantially perpendicular to a plane of the conveying mechanism.

22. The apparatus according to claim 1, wherein the coolant guard is angled toward the conveying mechanism.

23. The apparatus according to claim 1, wherein the coolant guard is angled away from the conveying mechanism.

24. The apparatus according to claim 1, wherein a height of the coolant guard is adjustable.

25. An apparatus for grinding a side edge of a panel, the apparatus comprising:

at least one grinder wheel positioned to grind the side edge of the panel;

a coolant device for supplying a coolant to the grinder wheel;

a conveying mechanism for conveying the panel such that the side edge of the panel can be ground by the grinder wheel;

a first coolant deflector for blocking coolant from contacting the conveying mechanism;

a coolant guard mounted adjacent the first coolant deflector and interposed between the conveying mechanism and the grinder wheel;

a first wiper affixed to the coolant guard and extending along the conveying mechanism such that a transported panel contacts the first wiper; and a wheel box, wherein the wheel box comprises a frame, a lid, a bottom plate, and enclosed on at least two sides, wherein the wheel box contains the grinder wheel;

wherein the coolant deflector is affixed to the bottom plate.

* * * * *